United States Patent [19]

Northup

[11] 4,091,948

[45] May 30, 1978

[54] LINERLESS CONTAINER CLOSURE

[76] Inventor: John D. Northup, 2460 Underhill Rd., Toledo, Ohio 43615

[21] Appl. No.: 713,679

[22] Filed: Aug. 12, 1976

Related U.S. Application Data

[63] Continuation-in-part of Ser. No. 666,594, March 15, 1976, abandoned.

[51] Int. Cl.[2] ..... B65D 53/00

[52] U.S. Cl. ..... 215/222; 215/329; 215/344; 215/DIG. 1

[58] Field of Search ..... 215/222, 329, 344, DIG. 1, 215/223

[56] References Cited

U.S. PATENT DOCUMENTS

| | | | |
|---|---|---|---|
| 3,215,297 | 11/1965 | Acton | 215/DIG. 1 |
| 3,232,470 | 2/1966 | Gibson | 215/344 |
| 3,255,909 | 6/1966 | Miller | 215/329 |
| 3,917,096 | 11/1975 | Hedgewick | 215/222 X |
| 3,951,289 | 4/1976 | Landen | 215/222 X |

*Primary Examiner*—Donald F. Norton
*Attorney, Agent, or Firm*—Allen Owen

[57] ABSTRACT

A container-closure combination is disclosed which meets current industry standards for tightness promulgated by the United States Pharmacopoeia XIX and The National Formulary XIV with an application torque of seven inch pounds or less.

5 Claims, 7 Drawing Figures

LINERLESS CONTAINER CLOSURE

REFERENCE TO RELATED APPLICATION

This is a continuation-in-part of my copending application Ser. No. 666,594, filed Mar. 15, 1976 (now abandoned).

BACKGROUND OF THE INVENTION

A substantial proportion of the prescription drugs dispensed today are in the form of pills, tablets or capsules. They are usually packaged by the pharmacist in an injection molded vial made of a thermoplastic material. The vial is usually closed with a plastic closure of the snap cap type or a one-piece child resistant closure with or without a liner. The child resistant closures require the simultaneous motions of pushing down and turning. Neither of these closure types makes a tight seal between the closure and the vial.

The National Formulary XIV and the United States Pharmacopoeia XIX have issued current standards for containers for drugs which require packaging and storing in a tight container or a well closed container. The standard includes a Moisture Vapor Penetration test for the container itself and for the closure. The procedure to be employed in the test is described in detail in the National Formulary XIV, pages 888–889. Each container and its closure must be closed tightly and opened 30 times before the test is begun. Then each container is filled with desiccated calcium chloride and sealed with an application torque as stated in the Table below:

| Container Diameter | Suggested application torque (in inch-pounds) |
|---|---|
| 28 mm. | 11–17 |
| 33 mm. | 13–20 |
| 38 mm. | 15–23 |
| 43 mm. | 17–26 |
| 48 mm. | 19–29 |
| 58 mm. | 23–35 |

After weighing each individual container, the containers are put in an atmosphere which is controlled as to temperature and humidity for a period of two weeks. They are then individually reweighed to determine the amount of moisture absorbed by the calcium chloride. This is related to the volume of the container to determine the weight of water absorbed stated in milligrams per liter of capacity per day. The weight of the absorbed water should not exceed 100 milligrams of water per liter of capacity per day if the seal is to be classified as tight by industry standards.

The moisture vapor penetration characteristic of a container is important because many drugs are subject to deterioration on prolonged exposure to moisture and many persons keep prescription drugs in the bathroom where the humidity is frequently high. The seal tightness suggested in the test is the standard generally accepted in the closure and container industries, based on their experiences of the torques required to seat a closure on a container sufficiently tight to insure protection of the contents in packages using the normal commercial liners. These liners are mostly wood pulp with a facing of polyvinylidine chloride or Saran. These suggested application torques are much higher than the torques that many of the people using prescription drugs can exert in securing a container cap.

The users of prescription drugs close the container many more times than does the pharmacist. The effectiveness of the seal when the user closes the container is the basic factor in determining whether the purity and efficacy of the drug will be maintained by the package. Many of the users of prescription drugs ar infirm, arthritic or sick. Others think of a closure as merely a device to keep the contents from spilling in the event the container is upset. Random tests in the 28 mm. size closure show that about half of the people normally reclose containers with three inch-pounds of torque and that few persons exert a torque greater than seven inch-pounds on this size closure.

STATEMENT OF THE PRESENT INVENTION

The object of the present invention is to make available a container and closure combination that will meet the National Formulary and U.S. Pharmacopoeia standards for a tightly closed container exhibiting a penetration of less than 100 mg. of water per liter of capacity per day when closed with a torque less than seven inch-pounds and in some configurations as low as only three inch-pounds on a 28 mm. closure. This compares with the suggested closure torque of 11–17 inch-pounds.

This seal is produced on prescription vials according to the invention by using a sealing fin type of screw closure and screw threaded container finish with a constantly tapering sealing surface much as shown in Miller et al U.S. Pat. No. 3,255,909 but with the fin and sealing surface angles changed to improve the performance radically. According to the invention, the container finish sealing surface is a downwardly and uniformly tapered surface from a tangent point on a very small radius at the top of the inside container finish, the taper being at an angle of 55° or less with the longitudinal axis of the container finish. The inner sealing surface of the undeformed fin of the closure with which the particular container is combined has its sealing surface disposed at an angle of from 10° to 20° less than the angle of the sealing surface above described.

The angle of the tapered sealing surface on the container finish must be less than 55° in order to provide an adequate width to the sealing surface. This width is limited by the thinness of the wall of the container finish, many of such walls being 0.040 inch or less.

The angle of the tapered sealing surface on the container finish is also critical in its relationship to the angle of the sealing surface of the closure fin. Excessive stretching of the fin by too large an angle of the tapered sealing surface on the container finish in relation to the angle of the fin sealing surface can deform the fin material beyond its elastic limit in the event of a high application torque. This results in a permanent deformation which destroys the balance between an effective moisture blocking seal and a low application torque. Proper design and control of the relationship of these angles within the limits disclosed in the closure-container combination of the present invention meet the Moisture Vapor Penetration standard of the National Formulary — U.S. Pharmacopoeia with an application torque between three inch-pounds and seven inch-pounds on a 28 mm. closure and within similar limits but at appropriately higher torques compatible with larger closures.

The angle between the sealing surface and the sealing lip is smaller than the angle suggested by the prior art. As this angle increases the tendency for the sealing lip to be permanently deformed increases. Thus, while a highly effective seal is formed with the high angle between the sealing lip and sealing surface disclosed in the art, the combination is not easily resealable with the same torque that was used to create the original seal. The present invention, as above noted, seals adequately at torques as low as three inch-pounds, exhibits no permanent deformation of the sealing lip, and is resealable over repeated cycles of removal and replacement of the closure.

It has been found that in this combination it is furthermore important the circle created by the top of the very small radius at the top of the container finish be at least as small as the circle defined by the intersection of the sealing fin centerline and the undersurface of the top panel of the closure. This is necessary to prevent the possibility of a wedging effect which creates a resistance to the application torque and may destroy the seal between the sealing surface of the closure fin and the sealing surface of the container finish.

DETAILED DESCRIPTION OF A PREFERRED EMBODIMENT

Figure 1:
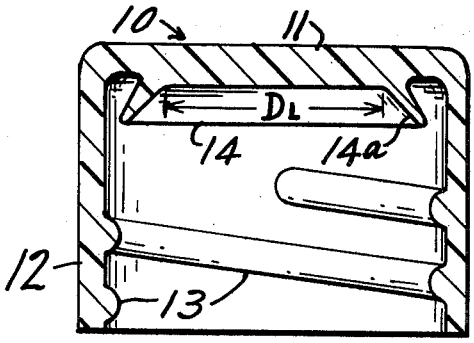
FIG. 1 is a central, vertical, sectional view of a closure having a sealing lip in accordance with the present invention.
Figure 3:
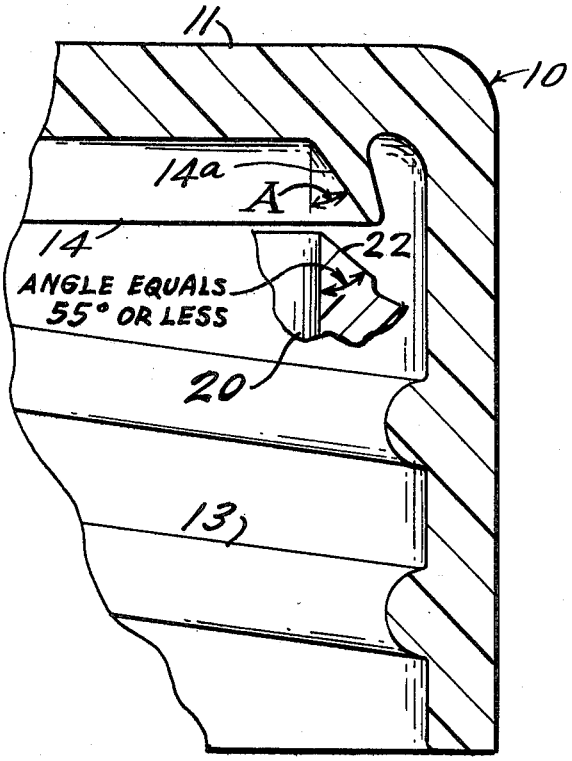
FIG. 3 is an enlarged vertical, sectional view, with parts broken away of the container finish and sealing lip immediately prior to application.
Figure 2:
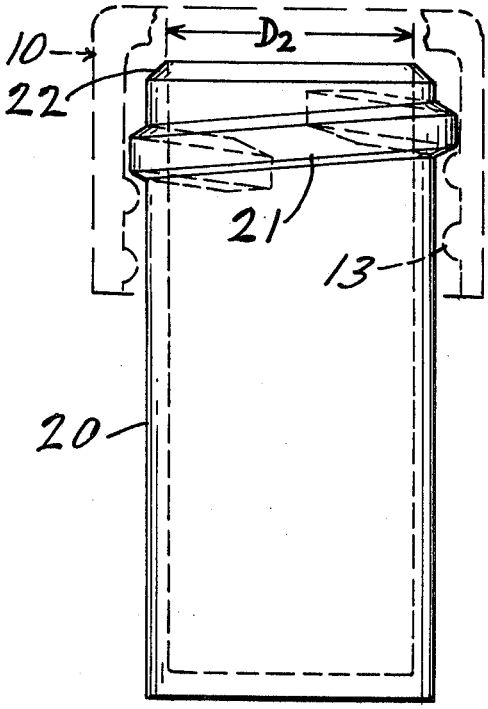
FIG. 2 is a central, vertical, sectional view of a container having a finish in accordance with the present invention, with the closure shown applied thereto in dotted lines.
Figure 4:
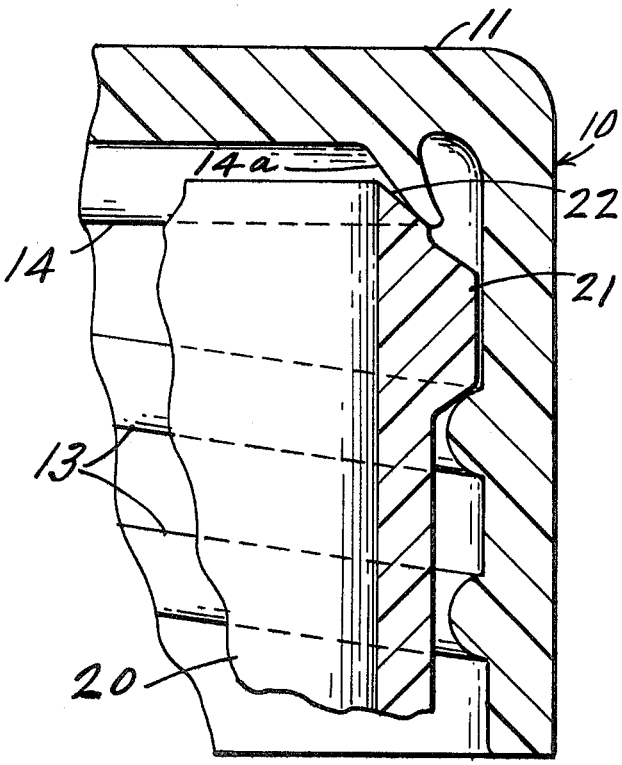
FIG. 4 is an enlarged vertical, sectional view of the parts in an applied position with the seal effected.

In the drawings, 10 designates a closure having a top panel 11 and a depending skirt 12. The skirt is threaded at 13 for attachment to a container body. A sealing lip or fin 14 extends from the top panel 11, downwardly and outwardly from the center. The lip 14 is preferably made thinner at its free edge than at its area of attachment to the top panel and the material from which the sealing lip 14 is made is resilient. The resiliency and mass of the lip are such that the lip will make a seal with the container when compressed, but will return to the original configuration when released. To this end, one satisfactory form of the lip is a tapered member having a thin free end.

The circle defined by the intersection of the inner portion of the sealing lip 14 and the top panel 11 has a diameter $D_L$. The sealing surface 14*a* of the sealing lip 14 makes an angle A with the vertical centerline of the closure, and angle A is preferably between 25° and 40°. This is the most satisfactory range of angles for forming the sealing lip 14.

The vial or other rigid container with which the closure 10 cooperates is designated generally 20. Threads 21 mate with threads 13 of the cap to bring the parts into sealing engagement. The container has a tapered sealing surface 22 extending from its open mouth which cooperates with the sealing lip 14 to complete a tight closure capable of full sealing engagement with an application torque of between three inch-pounds and seven inch-pounds. The angle of the sealing surface 22 with respect to the longitudinal axes of the vial is less than 55° and the difference in the angle and angle A above described is from 10° to 20°. The steepness of the sealing surface 22 contributes to the tightness of the seal because full engagement between the sealing lip and the tapered surface 22 is encouraged. Further the lip is not greatly deformed in use and the material of the sealing lip does not take a permanent set after an initial application under high torque, which might persist for a long period of time.

The tapered sealing surface 22 begins at a sharp radius at the top of the vial and continues as a straight line to the vial exterior. The circle formed by the smallest diameter of the tapered sealing surface has a diameter $D_2$ which is larger than the diameter $D_L$ of the circle defined by the intersection of the sealing lip 14 and the top panel 11. If $D_2$ is equal to or smaller than $D_L$, no proper seal will be formed when the closure is put on a vial because the sealing lip 14 may be wedged away from the tapered sealing surface 22.

While the drawings show a closure for use on an externally threaded container, it should be expressly understood that internal threads on the neck of the container will draw a plug-type closure against the sealing surface with equal facility. The invention resides in the relative angularity of the sealing lip and the cooperating tapered container sealing surface without regard to the means used to force the elements into engagement.

Figure 5:
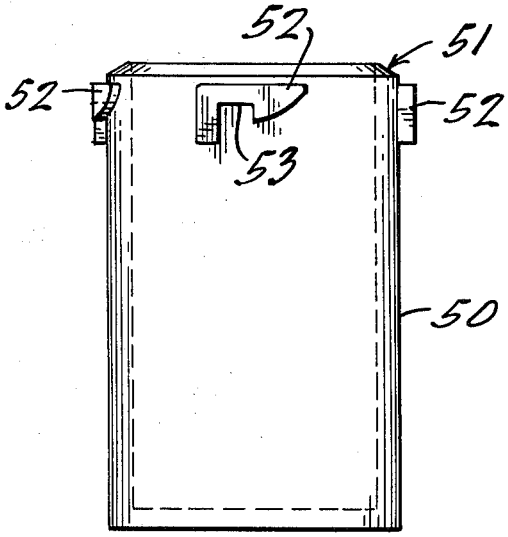
FIG. 5 is a side elevational view of a modified form of container.
Figure 6:
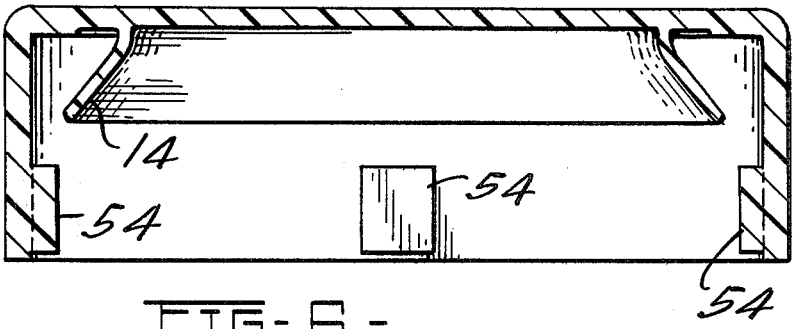
FIG. 6 is a cross-sectional view of a modified cap which cooperates with the container shown in FIG. 5.
Figure 7:
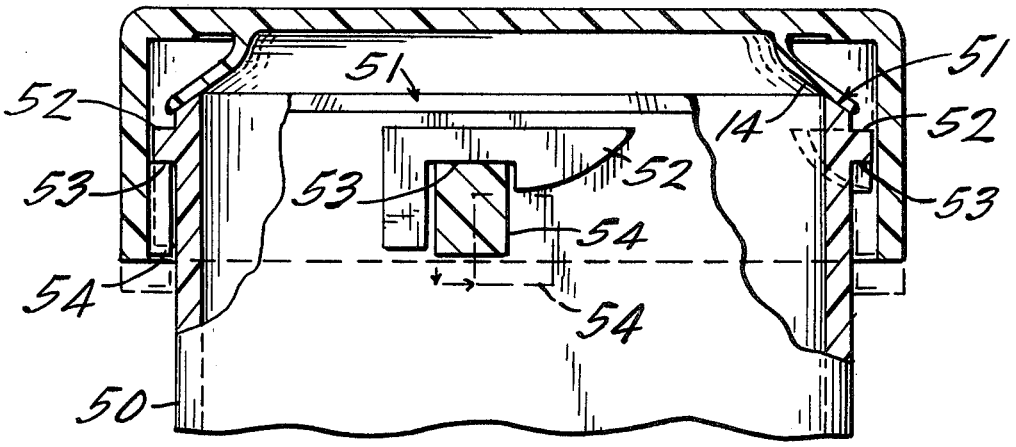
FIG. 7 is a view of an assembly of the cap of FIG. 6 on the container of FIG. 5.

For example, as shown in FIGS. 5, 6 and 7 of the drawings, the popular lug and notch child-proof cap may be used. In general attempts made in these caps to create any seal at all to protect the contents of the container have been of questionable value. In one instance of the prior art, Hedgewick, U.S. Pat. No. 3,344,942, an attempt has been made to seal against a flat radial finish on the container.

As shown in FIG. 5, a container 50 may be provided with a finish sealing surface 51 that extends downwardly at an angle of 55° or less with respect to the longitudinal axis of the container. A series of radially projecting lock members 52 is formed on the container, and the lock members have notches 53 formed therein. Lugs 54 are formed on the inner surface of the cap in a known manner and when the container is closed the lugs 54 engage in the notches 53. When this arrangement is used with the present invention, however, the notches 53 are made slightly shallower axially than is the usual case. The resiliency of the sealing lip 14 causes a biasing force to exist which not only urges the lugs into engagement with the notches 53, but also keeps the sealing lip 14 in sealing engagement with the tapered sealing surface of the container as shown in FIG. 7. The axial position of the notches and lugs is such that the sealing force persists when the container is closed and the sealing lip 14 always remains under pressure equivalent to that pressure which is created in the previously described embodiment wherein the threads disclosed require an application torque of not more than seven inch pounds for a 28 millimeter closure. Here, again, with close attention to dimensions a seal may be made with the lug and notch construction corresponding to an application torque on a 28 mm. container of not more than three inch pounds. With a slightly shallower notch, the application torque measurement of the seal may be increased to about seven inch pounds so that the tightness of the seal may be assured. The sealing pressure is most readily defined in terms normally used in the industry which are based on the sealing pressures brought about by "an application torque" of a magnitude stated in inch pounds. No attempt is usually made to measure the absolute force in an axial direction between the sealing surfaces.

What I claim:

1. A container-closure combination including a container having a neck portion terminating in a tapered sealing surface making an angle not greater than 55° to the longitudinal axis of the container, and a closure including an upper panel spanning the neck portion of the container, a resilient tapered sealing fin depending from the lower surface of said panel and extending downwardly and outwardly at an angle from 10° to 20° less than the angle made by said container sealing surface, and means on said container and said closure to bring said tapered fin into sealing engagement with said tapered sealing surface, the resiliency and mass of said fin being such that said seal is tight in accordance with the specification of National Formulary XIV, pp. 888–889 when the closure is applied with a sealing force not greater than that created by an application torque of seven inch-pounds for a 28 mm. closure.

2. The container closure combination defined in claim 1 in which said means to bring said tapered sealing fin into sealing engagement with said tapered sealing surface comprises cooperating threads on said cap and container.

3. A container-closure combination in accordance with claim 1 in which the required application torque for a tight seal on a 28 mm. closure is about three inch-pounds.

4. The container closure combination defined in claim 3 in which said means to bring said tapered sealing fin into sealing engagement with said tapered sealing surface comprises cooperating threads on said cap and container.

5. The container closure combination defined in claim 1 in which said means to bring said tapered sealing fin into sealing engagement with said tapered sealing surface comprises a series of lugs on the interior surface of said cap and a cooperating series of lock members formed on said container having notches to receive said lugs in locking engagement, the axial position of said locking members being such that when said lugs are in engagement therewith a sealing force is exerted between said sealing fin and said tapered sealing surface adequate to meet the National Formulary specification for a tightly closed container.

* * * * *